US008874008B2

(12) United States Patent
Okuno

(10) Patent No.: US 8,874,008 B2
(45) Date of Patent: Oct. 28, 2014

(54) DEVELOPING DEVICE AND IMAGE FORMING APPARATUS

(75) Inventor: Yuusuke Okuno, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 299 days.

(21) Appl. No.: 13/233,446

(22) Filed: Sep. 15, 2011

(65) Prior Publication Data

US 2012/0070194 A1 Mar. 22, 2012

(30) Foreign Application Priority Data

Sep. 21, 2010 (JP) ..... 2010-211084

(51) Int. Cl.
*G03G 15/08* (2006.01)

(52) U.S. Cl.
CPC ..... *G03G 15/0893* (2013.01); *G03G 15/0844* (2013.01)
USPC ..... 399/254

(58) Field of Classification Search
USPC ..... 399/254, 256
See application file for complete search history.

(56) References Cited

U.S. PATENT DOCUMENTS

| | | | | |
|---|---|---|---|---|
| 5,655,193 | A * | 8/1997 | Fujishiro et al. | 399/256 |
| 7,493,069 | B2 * | 2/2009 | Akedo | 399/254 X |
| 7,856,196 | B2 * | 12/2010 | Sakamoto et al. | 399/254 |
| 2009/0129820 | A1 * | 5/2009 | Kohno et al. | 399/254 |
| 2009/0214266 | A1 * | 8/2009 | Kato et al. | 399/254 |
| 2010/0239273 | A1 | 9/2010 | Kawasaki | |
| 2010/0322671 | A1 * | 12/2010 | Tsutsui et al. | 399/254 |

FOREIGN PATENT DOCUMENTS

| | | | |
|---|---|---|---|
| JP | 2004-094122 | A | 3/2004 |
| JP | 2005-221852 | A | 8/2005 |
| JP | 2006-323238 | A | 11/2006 |
| JP | 2008-250290 | A | 10/2008 |
| JP | 2009-058898 | A | 3/2009 |
| JP | 2010-044335 | A | 2/2010 |
| JP | 2010-122418 | A | 6/2010 |
| JP | 2010-217501 | A | 9/2010 |
| JP | 2010-223978 | A | 10/2010 |

OTHER PUBLICATIONS

Office Action (Notification of Reasons for Refusal) dated Jul. 17, 2012, issued in corresponding Japanese Patent Application No. 2010-211084, and an English Translation thereof (with Verification of Translation). (13 pages).

Office Action (Decision to Grant a Patent) dated Mar. 19, 2013, issued in corresponding Japanese Patent Application No. 2010-211084, and an English Translation thereof. (3 pages).

* cited by examiner

*Primary Examiner* — Sandra Brase
(74) *Attorney, Agent, or Firm* — Buchanan Ingersoll & Rooney PC

(57) ABSTRACT

Developing device supplying developer to developing roller, while causing developer to circulate in passage including first and second conveying passages in parallel, and while ejecting part of developer to outside via ejection passage formed as extension of first conveying passage on downstream side in developer conveying direction, developing roller being provided along first conveying passage. Developing device includes: first communication path provided as branch of first conveying passage on downstream side, allowing first passage to communicate with second passage; first conveying part conveying developer in first passage toward first communication path; and entrance allowance unit allowing developer to enter ejection passage from first passage depending on pressure of developer in first passage, first conveying part including main and sub-conveying parts, main conveying part being provided in region corresponding to roller, sub-conveying part, provided downstream of main conveying part, conveying smaller amount of developer per unit time than main conveying part.

10 Claims, 8 Drawing Sheets

33Y

DEVELOPING DEVICE AND IMAGE FORMING APPARATUS

This application is based on application No. 2010-211084 filed in Japan, the content of which is hereby incorporated by reference.

BACKGROUND OF THE INVENTION (1) Field of the Invention

The present invention relates to a developing device and an image forming apparatus including the developing device, and in particular to a technology for stabilizing the amount of developer in a developing tank in a developing device of a trickle system using a two-component developer.

(2) Description of Related Art

In recent years, developing devices of a so-called trickle developing system have become popular, among developing devices of a two-component developing system in which a developer composed of toner and carrier is used. In the developing devices of the trickle developing system, as disclosed in Japanese Patent Application Publication No. 2005-221852 for example, while a part of the developer is kept to be ejected to outside of a developing tank from an outlet, a fresh developer is replenished into the developing tank so that a carrier with a decreased charging capability is replaced with a fresh carrier.

FIG. 8 is a schematic cross sectional view illustrating a conventional structure of a developing device 500 adopting such a trickle developing system.

As shown in FIG. 8, the developing device 500 includes a developing roller 531, a conveying screw 532, a stirring screw 533, and a housing 534 housing these.

The inner space of the housing 534 is partitioned by a partition wall 534*e* into a first conveying passage 534*a* and a second conveying passage 534*b*, with a first communication path 536*a* and a second communication path 536*b* being formed for communications between the first conveying passage 534*a* and the second conveying passage 534*b*. These passages and paths form a circulating passage 534*f* in which the developer is circulated.

Also, a developer ejecting passage 534*c* is formed as an extension of the first conveying passage 534*a* on the downstream side in the developer conveying direction, and a developer supply passage 534*d* is formed as an extension of the second conveying passage 534*b* on the upstream side in the developer conveying direction (hereinafter, the upstream side and the downstream side in the developer conveying direction in each conveying passage may be merely referred to as "upstream side" and "downstream side" in each conveying passage, respectively).

The developing roller 531 is formed along the first conveying passage 534*a*.

The conveying screw 532 and the stirring screw 533 are spiral screws. Among these, the conveying screw 532 is installed in the first conveying passage 534*a* to convey the developer therein toward the first communication path 536*a*.

Furthermore, a reverse winding screw 532*c* is provided at a position corresponding to the first communication path 536*a* on the downstream side of the first conveying passage 534*a*. The reverse winding screw 532*c* is a screw sharing a rotation shaft with the conveying screw 532, and the vanes thereof are attached to the rotation shaft at a reverse angle of an angle at which the vanes of the conveying screw 532 are attached.

With the above structure, a small amount of developer (toner and carrier) continues to be supplied from a toner replenishing device (not illustrated) into the housing 534 via an inlet hole 538. The developer is conveyed through the developer supply passage 534*d* to the second conveying passage 534*b*, and there it is mixed by an operation of the stirring screw 533 with a developer conveyed from the first conveying passage 534*a* via the first communication path 536*a*, and then the developer is conveyed to the first conveying passage 534*a* via the second communication path 536*b*.

In this circulation, the developer reaches the reverse winding screw 532*c* on the downstream side of the first conveying passage 534*a*. However, when a small amount of developer is present in the first conveying passage 534*a*, the developer having reached the reverse winding screw 532*c* is pushed back in the reverse direction. As a result, most of the developer is conveyed to the second conveying passage 534*b* through the first communication path 536*a*.

On the other hand, when a large amount of developer is present in the first conveying passage 534*a*, although the developer having reached the reverse winding screw 532*c* receives a force pushing back the developer in the reverse direction, the pressure of the developer congesting in a region G in front of the reverse winding screw 532*c* is high, and the developer overcomes the pushing back force of the reverse winding screw 532*c* and passes the reverse winding screw 532*c*, and is ejected into a collection box (not illustrated) via an outlet hole 537. With this structure, the amount of developer in the housing 534 is kept to be stable.

However, in some types of electrophotographic image forming apparatuses, the speed of the entire process (system speed) varies depending on the type of paper or due to the image quality driving. In such types of electrophotographic image forming apparatuses, when the system speed changes, the speed at which the developer circulates in the developing device 500 changes as well. This causes the pressure and/or bulk of the developer to change partially.

In a developing device with the above structure illustrated in FIG. 8, the amount of ejected developer basically depends on the pressure of developer in the region G on the downstream side in the first conveying passage 534*a*. That is to say, it receives directly the influence of change of pressure due to the change of the system speed. Accordingly, it is difficult for the developing device to keep the amount of developer constant.

For example, when driven at a high speed, both of the following increase: (i) an amount of developer conveyed per unit time by the conveying screw 532 in the forward direction (hereinafter, the amount is referred to as "conveying power"); and (ii) an amount of developer conveyed per unit time by the reverse winding screw 532*c* in the reverse direction. Due to this, the pressure of the developer in the region G increases as well. Normally, the conveying power in the forward direction is set to be larger than that in the reverse direction. In that case, there is a possibility that, when the device is driven at a high speed, the conveying power in the forward direction increases more than the conveying power in the reverse direction, the difference between the conveying powers in the forward and reverse directions becomes large, the pressure of the developer increases, an excessive amount of developer passes the reverse winding screw 532*c* to be ejected, and a more amount of developer is ejected than when the device is driven at a low speed.

In particular, in order to respond to the demand for miniaturization of image forming apparatuses in recent years, the developing device itself is required to be smaller. Accordingly, the capacity of the developing tank in the developing device has to be smaller as well. In that case, a slight difference in the amount of ejected developer may greatly change the height of the liquid surface of the developer contained in the supply conveying passage facing the developing roller, and if the height of the developer decreases temporarily due to ejection of an excessive amount of developer, a sufficient amount of developer may not be supplied to the developing roller, and an uneven image may occur.

SUMMARY OF THE INVENTION

It is therefore an object of the present invention to provide a developing device of a trickle system for restricting a change in the amount of ejected developer when the system speed changes, thereby stabilizing the amount of developer in the developing device and preventing an uneven image from occurring.

In one aspect of the present invention, the above object is fulfilled by a developing device supplying a two-component developer to a developing roller, while causing the developer to circulate in a circulating passage including a first conveying passage and a second conveying passage arranged in parallel to each other, and while ejecting a part of the developer to outside via an ejection passage formed as an extension of the first conveying passage on a downstream side in a developer conveying direction, the developing roller being provided along the first conveying passage, the developing device comprising: a first communication path provided as a branch of the first conveying passage on the downstream side in the developer conveying direction and configured to allow the first conveying passage to communicate with the second conveying passage; a first conveying part configured to convey the developer in the first conveying passage toward the first communication path; and an entrance allowance unit configured to allow the developer to enter the ejection passage from the first conveying passage depending on a pressure of the developer in the first conveying passage, the first conveying part including a main conveying part and a sub-conveying part, the main conveying part being provided to cover at least a region corresponding to the developing roller, and the sub-conveying part, provided downstream of the main conveying part in the developer conveying direction, conveying a smaller amount of developer per unit time than the main conveying part.

In another aspect of the present invention, the above object is fulfilled by an image forming apparatus provided with a developing device supplying a two-component developer to a developing roller, while causing the developer to circulate in a circulating passage including a first conveying passage and a second conveying passage arranged in parallel to each other, and while ejecting a part of the developer to outside via an ejection passage formed as an extension of the first conveying passage on a downstream side in a developer conveying direction, the developing roller being provided along the first conveying passage, the developing device including: a first communication path provided as a branch of the first conveying passage on the downstream side in the developer conveying direction and configured to allow the first conveying passage to communicate with the second conveying passage; a first conveying part configured to convey the developer in the first conveying passage toward the first communication path; and an entrance allowance unit configured to allow the developer to enter the ejection passage from the first conveying passage depending on a pressure of the developer in the first conveying passage, the first conveying part including a main conveying part and a sub-conveying part, the main conveying part being provided to cover at least a region corresponding to the developing roller, and the sub-conveying part, provided downstream of the main conveying part in the developer conveying direction, conveying a smaller amount of developer per unit time than the main conveying part.

BRIEF DESCRIPTION OF THE DRAWINGS

These and other objects, advantages and features of the invention will become apparent from the following description thereof taken in conjunction with the accompanying drawings that illustrate a specific embodiment of the invention.

In the drawings.

DESCRIPTION OF PREFERRED EMBODIMENTS

The following describes an embodiment of an electrophotographic image forming apparatus including a developing device of the present invention, taking a color printer (hereinafter, merely referred to as a printer) as an example.

(1) Overall Structure of Printer 1

Figure 1:
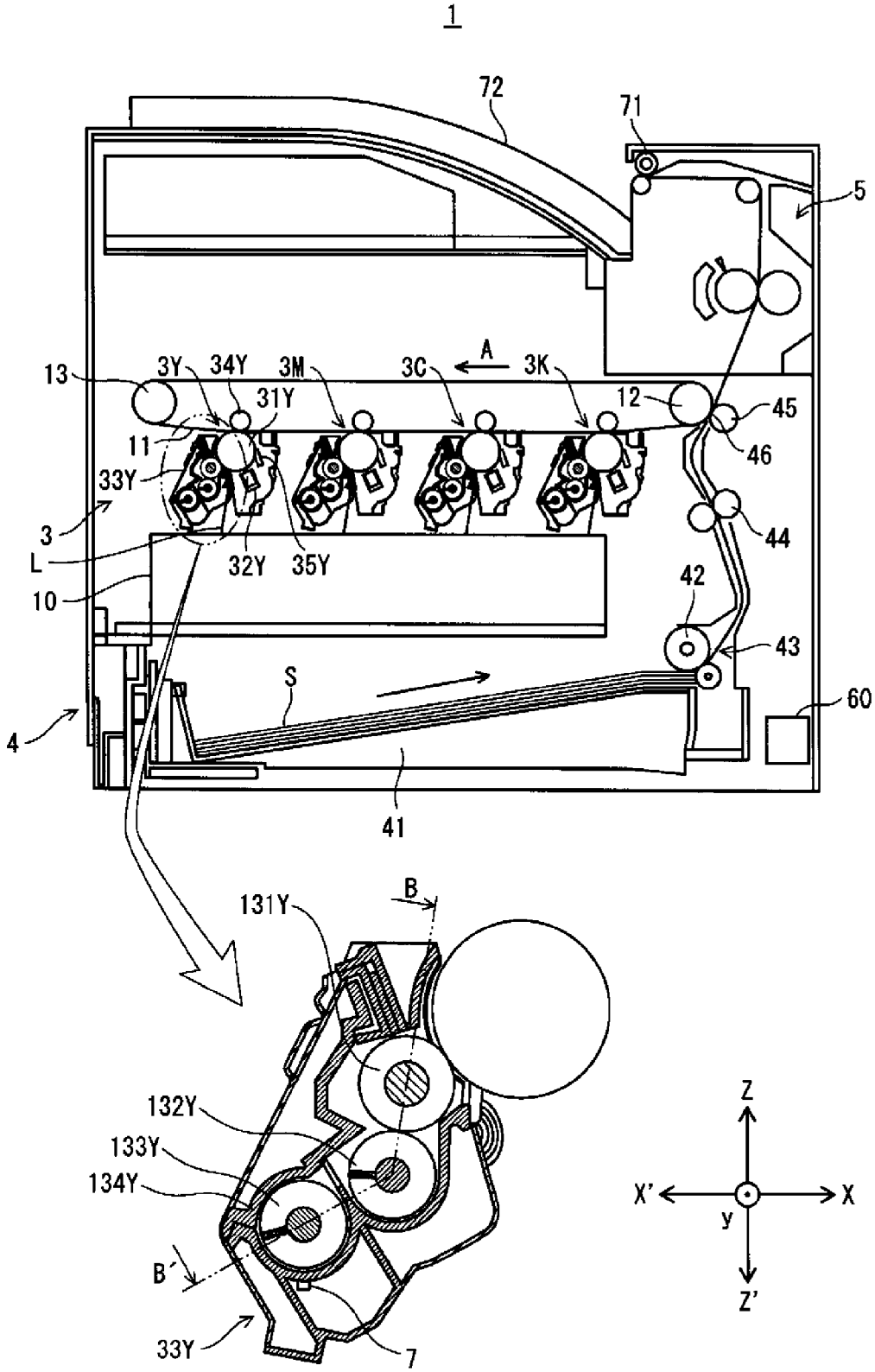
FIG. 1 is a cross sectional schematic diagram illustrating an overall structure of the printer in an embodiment of the present invention.

FIG. 1 is a cross sectional schematic diagram illustrating an overall structure of the printer 1.

As shown in FIG. 1, the printer 1 includes an image processor 3, a paper feeder 4, a fixing unit 5, and a controller 60. The printer 1 is a so-called tandem color printer which, upon receiving an instruction to execute a print job from an external terminal device (not illustrated), forms toner images of yellow, magenta, cyan, and black based on the instruction, and forms a full-color image by performing a multi-transfer, namely, by transferring the toner images of these colors.

Hereinafter, the reproduction colors of yellow, magenta, cyan, and black are represented by Y, M, C, and K, respectively, and any structural component related to one of the reproduction colors is represented by a numeral attached with a corresponding character, Y, M, C, or K.

The image processor 3 includes image creating units 3Y, 3M, 3C, and 3K corresponding respectively to colors Y, M, C, and K, an optical unit 10, and an intermediate transfer belt 11.

The image creating unit 3Y is provided with a photosensitive drum 31Y and around the photosensitive drum 31Y: a charger 32Y; a developing unit 33Y; a first transfer roller 34Y; and a cleaner 35Y for cleaning the photosensitive drum 31Y. The image creating unit 3Y creates a toner image of color Y on the photosensitive drum 31Y. The other image creating units 3M through 3K have the same structure as the image creating unit 3Y, and thus reference signs for these units are omitted in FIG. 1.

The intermediate transfer belt 11 is an endless belt, suspended with a tension between a drive roller 12 and a passive roller 13, and is driven to move cyclically in the direction indicated by the arrow "A".

The optical unit 10 is provided with light-emitting devices such as laser diodes, which, in accordance with a drive signal from the controller 60, emit laser beams L for forming images of colors Y-K and expose-scan the photosensitive drums 31Y-31K.

This expose-scanning causes electrostatic latent images to be formed on the photosensitive drums 31Y-31K having been charged by the chargers 32Y-32K. The electrostatic latent images are developed by the developing units 33Y-33K, and toner images of colors Y-K are formed on the photosensitive drums 31Y-31K, respectively. The image formations by the developing units 33Y-33K are performed at shifted timings so that the images are layered at the same position on the intermediate transfer belt 11 as the first transfer.

Toner images of respective colors are transferred onto the intermediate transfer belt 11 in sequence by the electrostatic action of the first transfer rollers 34Y-34K, and toner images for full color are formed. The toner image are further transported toward a second transfer position 46 by the intermediate transfer belt 11.

On the other hand, the paper feeder 4, which includes: a paper feed cassette 41 that houses recording sheets S; a feed roller 42 for feeding the recording sheets S one by one from the paper feed cassette 41 to a transport passage 43; and a pair of timing rollers 44 for adjusting the timing for feeding a recording sheet S to the second transfer position 46, feeds a recording sheet S toward the second transfer position 46 at the timing corresponding to the timing at which the toner images on the intermediate transfer belt 11 reach the second transfer position 46. The toner images on the intermediate transfer belt 11 are transferred onto a recording sheet S in block by the action of the second transfer roller 45. This transfer is referred to as the second transfer.

The recording sheet S having passed through the second transfer position 46 is transported to the fixing unit 5, in which it is heated and pressed, so that the toner image (unfixed image) on the recording sheet S is fixed onto the recording sheet S, and the recording sheet S is ejected onto a tray 72 via a pair of ejection rollers 71.

The controller 60 includes a CPU, a communication interface, a ROM, and a RAM. Upon receiving a print job from an external client terminal via the communication interface, the CPU reads a predetermined program from the ROM, and controls the image processor 3, paper feeder 4, fixing unit 5 and the like to execute an image forming operation smoothly.

Note that, in the present embodiment, the controller 60 can control the image forming operation by changing the system speed depending on the type of paper selected by the user.

More specifically, in the case of regular paper, the controller 60 forms images by driving the system at a high-speed (high-speed mode), and in the case of thick paper or an OHP sheet, the controller 60 forms images by driving the system at a low-speed (low-speed mode).

Also, the controller 60 performs a developer supply control for supplying, from a developer replenishing tank (not illustrated), a two-component developer containing a non-magnetic toner (hereinafter referred to as "toner") and a magnetic carrier (hereinafter referred to as "carrier") to a housing 134Y which is a developing tank of a developing unit 33Y.

Here, the bottom of the housing 134Y is provided with a magnetic sensor 7 for detecting a toner concentration of the developer. The controller 60 performs a control to keep the toner concentration in the developing unit 33Y constant by adjusting the amount of supplied developer. For this purpose, the controller 60 controls, for example, the open/close operation of the shutter (not illustrated) of the developer replenishing tank (not illustrated) based on the output value of the magnetic sensor indexing the toner concentration. For this control, for example, a known technology disclosed in Japanese Patent Application Publication No. 2004-094122 is used.

Note that the above developer supply control is performed to keep the toner concentration constant, and not for the purpose of controlling the amount of the developer in the developing units 33Y through 33K.

(2) Structure of Developing Unit

<Overall Structure>

The developing units 33Y-33K have the same structure except for the color of toner supplied by them. Thus in the following, an explanation is given of the developing unit 33Y as an example, and explanation of the other developing units is omitted.

Figure 2:
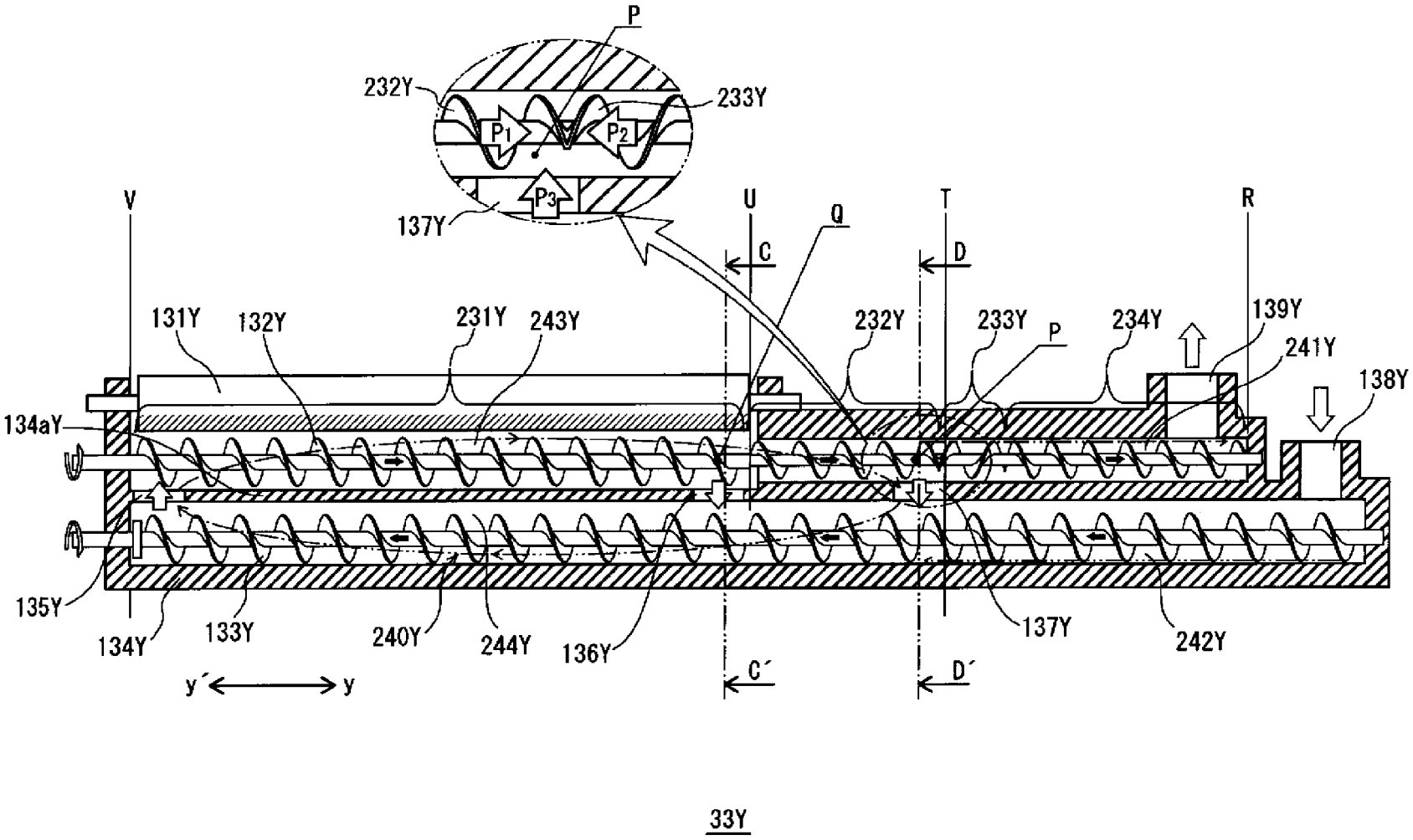
FIG. 2 is a cross sectional view illustrating the structure of the developing device in the embodiment of the present invention.

FIG. 2 is a cross sectional view of the developing unit 33Y, taken along line B-B' of FIG. 1.

The developing unit 33Y is based on the trickle system in which a two-component developer containing carrier and toner is used, and includes the housing 134Y and also includes, inside the housing 134Y, a stirring screw 133Y, a supply screw 132Y, and a developing roller 131Y.

More specifically, in the housing 134Y, the supply screw 132Y and the stirring screw 133Y are installed in parallel to each other, and a partition wall 134*a*Y is provided between the two screws, partitioning the space in the housing 134Y into two spaces respectively constituting a first conveying passage 243Y and a second conveying passage 244Y.

Also, a developer ejection passage 241Y is formed as an extension of the first conveying passage 243Y on the downstream side, and a developer outlet hole 139Y for ejecting the developer is provided in the vicinity of an end of the developer ejection passage 241Y.

A developer supply passage 242Y is formed as an extension of the second conveyance passage 244Y on the upstream side, and the developer is supplied via a developer inlet hole 138Y provided in the vicinity of an end of the developer supply passage 242Y, from a developer replenishing tank (not illustrated).

Note that, in the present embodiment, both (i) a boundary between the first conveying passage 243Y and the developer ejection passage 241Y and (ii) a boundary between the second conveying passage 244Y and the developer supply passage 242Y, are present on an auxiliary line T indicated in FIG. 2.

Also, the developing roller 131Y is a known magnetic roller provided in a sleeve installed rotatably in the housing 134Y, and is provided along the supply screw 132Y and the first conveying passage 243Y.

The first conveying passage 243Y and the second conveying passage 244Y are communicated with each other through a first communication path 137Y, a second communication path 136Y, and a third communication path 135Y. These passages and paths form a circulating passage 240 in which the developer is circulated.

The first communication path 137Y is positioned at a position P located on the most downstream side of the first conveying passage 243Y and in front of the developer ejection passage 241Y. The second communication path 136Y is positioned at a position Q in the first conveying passage 243Y, the position corresponding to a right-hand-side end of the developing roller 131Y (the position Q is located on the most downstream side of a first conveying part 231Y and in front of a second conveying part 232Y, wherein the first conveying part 231Y and the second conveying part 232Y are described below).

The third communication path 135Y is located on the most upstream side of the first conveying passage 243Y.

The above first communication path 137Y and second communication path 136Y are formed as branches of the first conveying passage 243Y. Accordingly, hereinafter, the above positions P and Q are referred to as "first branch point P" and "second branch point Q", respectively.

Note that in FIG. 2, an opening is illustrated in the cross section for the sake of understanding so that the position of the second communication path 136Y in the axis direction can be easily recognized, but in the actuality, the opening of the second communication path 136Y is positioned higher than illustrated (see FIG. 3A described below).

The supply screw 132Y and the stirring screw 133Y respectively provided in the first conveying passage 243Y and the second conveying passage 244Y are each a spiral screw that is formed by attaching spiral vanes to a shaft at a predetermined pitch. The supply screw 132Y and the stirring screw 133Y are driven by respective driving devices (not illustrated) to rotate in respective directions indicated by the white arrows shown on the left-hand side of the drawing.

The supply screw 132Y is structured to extend into the developer ejection passage 241Y and include, from the upstream side to the downstream side in the developer conveying direction, the first conveying part 231Y (a main conveying part), the second conveying part 232Y (a sub-conveying part), a third conveying part 233Y (an entrance allowance unit), and a fourth conveying unit 234Y, the conveying units 231Y to 234Y having different shapes of screws.

The first conveying part 231Y is provided to cover at least a range (a range extending from an auxiliary line V to an auxiliary line U) corresponding to the developing roller 131Y, wherein the screw diameter, the pitch, and the shaft diameter are set to 13 mm, 25 mm, and 6 mm, respectively. When driven to rotate, the first conveying part 231Y conveys the developer in the y direction.

The second conveying part 232Y is present in a range extending from the downstream side of the first conveying part 231Y to the first branch point P (a range extending from the auxiliary line U to approximately an auxiliary line T). The conveying direction of the second conveying part 232Y is the same as the first conveying part 231Y, but the second conveying part 232Y is set to have a smaller conveying power than the first conveying part 231Y.

For the second conveying part 232Y, the screw diameter is set to 11 mm, the pitch to 12.5 mm, the number of turns to "4", and the shaft diameter to 6 mm, for example.

The third conveying part 233Y is provided approximately at an inlet of the developer ejection passage 241Y, downstream of the first branch point P. The spiral direction of the spiral screws of the third conveying part 233Y is reversed to the other portions so that the conveying power of the third conveying part 233Y acts in the reverse direction of the conveying power of the second conveying part 232Y. Also, the absolute value of the conveying power of the third conveying part 233Y is designed to be smaller than that of the second conveying part 232Y by a predetermined amount.

Specifically, for the third conveying part 233Y, the screw diameter is set to 11 mm, the pitch to 5 mm, the number of turns to "3", and the shaft diameter to 6 mm, for example.

The present embodiment is structured such that, when the pressure of the developer at the first branch point P increases to some extent, the pressure of the developer overcomes the conveying power of the third conveying part 233Y in the reverse direction, and a part of the developer flows into the developer ejection passage 241Y. This will be described in detail later.

The fourth conveying unit 234Y is present in a range extending from the downstream side of the third conveying part 233Y to an end of the developer outlet hole 139Y (the position indicated by an auxiliary line R), and conveys the developer, which has entered therein passing the third conveying part 233Y, further in the y direction, and ejects the developer into a developer collection container (not illustrated) via the developer outlet hole 139Y. For the spiral screw of this portion, the screw diameter is set to 11 mm, the pitch to 12.5 mm, and the shaft diameter to 6 mm, for example.

Note that the inner shape of the housing 134Y changes as the screw diameters of the first through fourth conveying units 231Y through 234Y change so that a distance between the supply screw 132Y and the inner wall of the housing 134Y surrounding it can be kept to be constant.

Also, the stirring screw 133Y is structured to extend from the second conveying passage 244Y into the developer supply passage 242Y and conveys the developer toward the y' direction while stirring the developer therein. For the spiral screw of this portion, the screw diameter is set to 13 mm, the pitch to 25 mm, and the shaft diameter to 6 mm, for example.

<Shape and so on of First and Second Communication Paths>

Figure 3A:
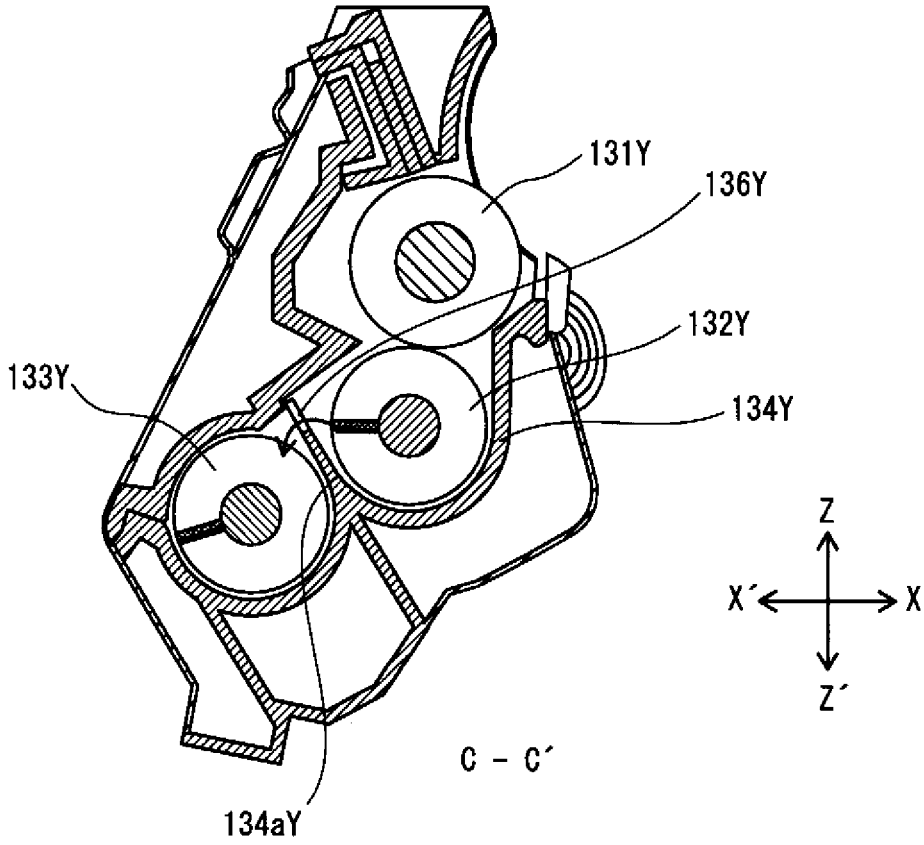
FIG. 3A is a cross sectional view of the developing device in the embodiment of the present invention taken along the line C-C' of FIG. 2, looking in the direction of the arrows.
Figure 3B:
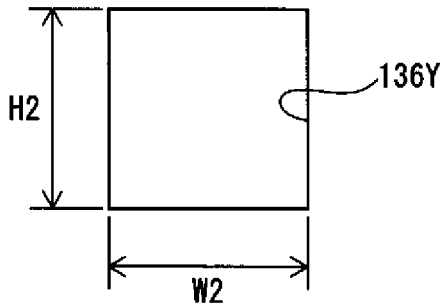
FIG. 3B illustrates an opening of the second communication path.
Figure 4A:
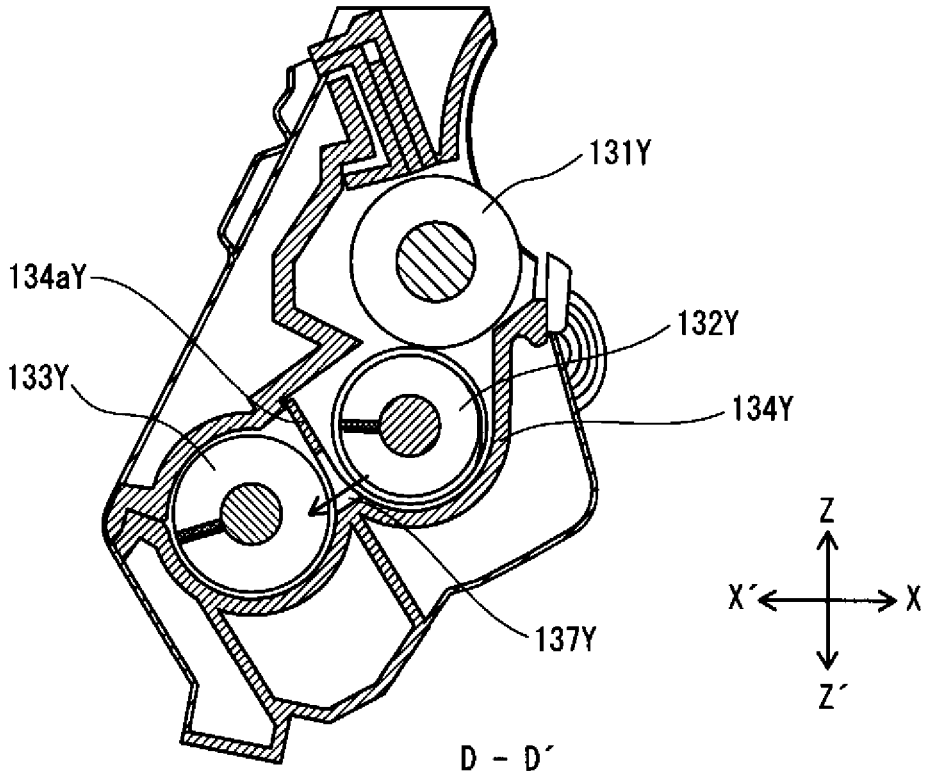
FIG. 4A is a cross sectional view of the developing device in the embodiment of the present invention taken along the line D-D' of FIG. 2, looking in the direction of the arrows.
Figure 4B:
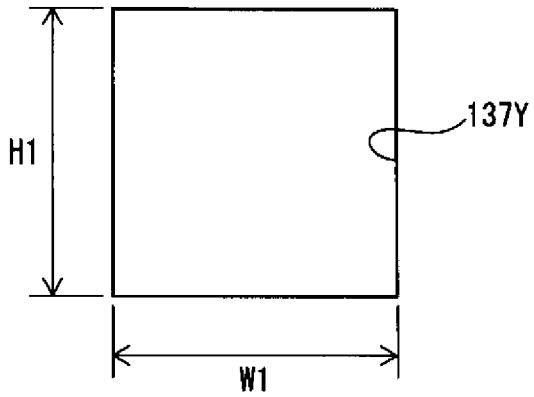
FIG. 4B illustrates an opening of the first communication path.

FIG. 3A is a cross sectional view taken along the line C-C' of FIG. 2, looking in the direction of the arrows. FIG. 3B is an enlarged view of an opening of the second communication path 136Y looking in a direction perpendicular to the partition wall 134*a*Y. FIG. 4A is a cross sectional view taken along the line D-D' of FIG. 2, looking in the direction of the arrows. FIG. 4B is an enlarged view of an opening of the first communication path 137Y shown in FIG. 4A looking in a direction perpendicular to the partition wall 134*a*Y.

As shown in FIGS. 3B and 4B, in the present embodiment, the openings of the first communication path 137Y and the second communication path 136Y are each in a rectangular shape, the first communication path 137Y is set to be larger than the second communication path 136Y in height and width of the opening (H1>H2, W1>W2), and the first communication path 137Y is larger than the second communication path 136Y in flow passage cross sectional area (area of the opening).

Here, the term "flow passage cross sectional area" is defined as a cross sectional area of a flow passage when the flow passage (communication path) is taken along a plane that is perpendicular to the direction in which the developer flows in the flow passage. In the case where the flow passage is long, and the flow passage cross sectional area varies between the entrance and the exit thereof, the term "flow passage cross sectional area" means the minimum flow passage cross sectional area. This is because the difficulty with which the developer flows is determined depending on the size of the minimum flow passage cross sectional area.

Furthermore, as shown in FIGS. 3A and 4A, it is structured so that the position of the lowest portion (lower side) of the opening of the second communication path 136Y is higher than the position of the lowest portion (lower side) of the opening of the first communication path 137Y in the vertical direction (the z axis direction).

With this structure, among the developer having been conveyed through the first conveying passage 243Y to the second branch point Q, only a part of the developer that passes over the lowest portion of the second communication path 136Y enters the second conveying passage 244Y via the second communication path 136Y, and the remaining part is conveyed to the first branch point P by the second conveying part 232Y. That is to say, the second communication path 136Y is a so-called bypass path that causes a part of the developer, which has overflowed passing a predetermined height in a region of the first conveying passage 243Y corresponding to the developing roller 131Y, to enter the second conveying passage 244Y (hereinafter, the region is referred to as "developing roller region").

Also, it is structured so that the developer flows in the second communication path 136Y with more difficulty than in the first communication path 137Y. This structure makes it difficult for the liquid surface of the developer in the developing roller region to be lowered, making it difficult for a failure to supply the developing roller with the developer to occur.

Also, with this structure, among the developer at the second branch point Q, the developer that flows from the first conveying passage 243Y to the second conveying passage 244Y via the second conveying part 232Y through the first communication path 137Y is larger in amount than the developer that flows thereto through the second communication path 136Y. That is to say, the amount of the developer that circulates a longer distance in the circulating passage increases. In this case, the length of the passage in which the developer is circulated is extended, and the time during which the developer is stirred with the new developer replenished from the developer inlet hole 138Y is increased, and thus the old and new developers are stirred better.

In the present embodiment, in order to realize the structure in which the developer flows in the second communication path 136Y with more difficulty than in the first communication path 137Y, (i) the position of the lowest portion of the opening of the second communication path 136Y is set to be higher than the position of the lowest portion of the opening of the first communication path 137Y, and (ii) the second communication path 136Y is set to be smaller than the first communication path 137Y in flow passage cross sectional area. However, instead of both of the above structures (i) and (ii), only one of them may be adopted.

Also, the position of the second communication path 136Y in the vertical direction, and the size of the flow passage cross sectional area in the first communication path 137Y and the second communication path 136Y are determined appropriately through experiment or the like, taking into accounts the size of the conveying power of the first conveying part 231Y and the second conveying part 232Y, and the capacity of the developing roller region, so that a developer clogging or the like does not occur.

<Ejection of Developer>

At what rate the developer, having been conveyed to the first branch point P by the second conveying part 232Y, is caused to flow into the developer ejection passage 241Y to be ejected depends on the size of the pressure given to the developer at the first branch point P.

An enlargement encircled by a two-dot chain line in FIG. 2 indicates the pressure state in the vicinity of the first branch point P in the developing unit 33Y.

As illustrated schematically in FIG. 2, at the first branch point P, the following pressures P1 through P3 are given to the developer.

P1: a pressure generated when the second conveying part 232Y attempts to convey the developer toward the first branch point P P2: a pressure generated when the third conveying part 233Y, with its reverse-conveying power, pushes back the developer toward the first branch point P P3: a resistive force acting at the opening of the first communication path 137Y to prevent the developer from passing Note that the flow passage cross sectional area of the first communication path 137Y is determined so that P3 is set to a smaller value than P1 or P2.

For this purpose, it is structured so that, although much of the developer having reached the first branch point P is conveyed to the second conveying passage 244Y via the first communication path 137Y, if the total sum of the pressure at this point becomes large and reaches to a certain level, a part of the developer overcomes the push-back pressure P2 of the third conveying part 233Y, passes the third conveying part 233Y and is ejected to outside of the housing 134Y via the developer outlet hole 139Y.

That is to say, since the above three pressures P1, P2 and P3 act at the first branch point P, the respective amounts of developer that flow into the ejection passage (a passage toward the developer ejection passage 241Y) and the main circulating passage (a passage toward the second conveying passage 244Y) are determined in accordance with the balance among the three pressures P1, P2 and P3.

Of course, when the amount of developer in the housing 134Y increases, the developer concentration at the first branch point P and the pressure applied to the developer at the first branch point P increase as well, and the amount of developer that passes the third conveying part 233Y and is ejected via the developer outlet hole 139Y increases as well, so that the amount of developer in the developing unit is kept to be in a predetermined range.

Furthermore, as the system speed is switched to a high-speed mode, the rotation speed of each screw is increased, and both pressures P1 and P2 increase. However, in the present embodiment, the conveying power of the second conveying part 232Y, which influences the value of pressure P1 greatly, is set to be smaller than that of the first conveying part 231Y. Accordingly, compared with the conventional technologies in which the amount of increase in the pressure depends on the conveying power of the first conveying part 231Y, the amount of increase in the pressure is small.

Figure 5:
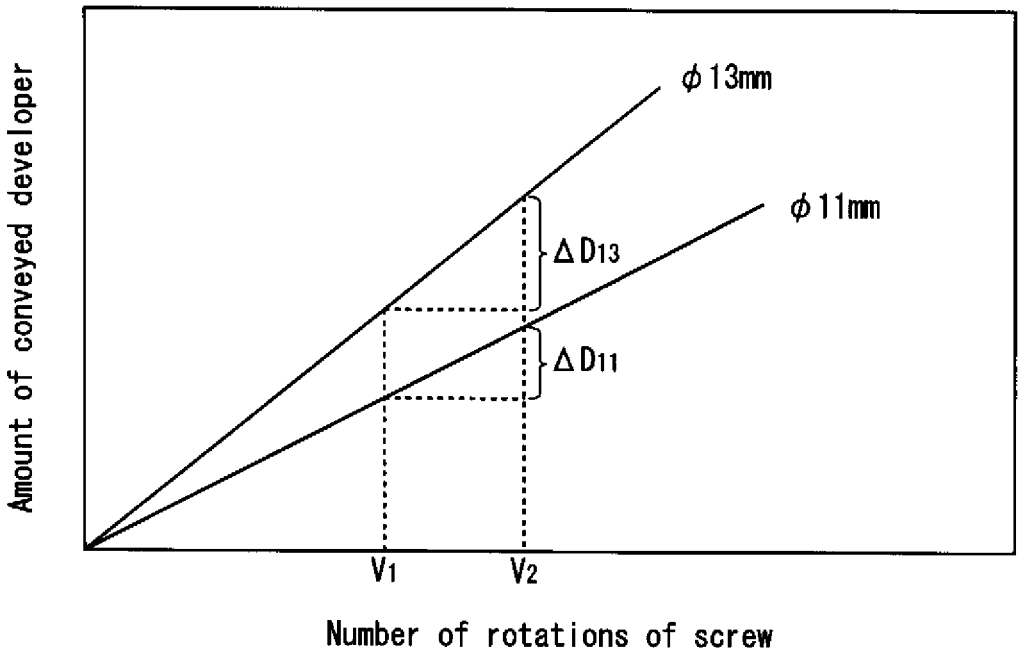
FIG. 5 is a graph indicating a relationship between the screw diameter and the amount of developer conveyed per unit time.

FIG. 5 is a graph indicating the amount of developer conveyed per unit time measured in two samples of the spiral-screw-type conveying units that are different only in screw diameter, with the same screw pitch.

As shown in FIG. 5, the amount of developer conveyed per unit time by the conveying unit with a screw diameter of 11 mm is approximately 64% of the amount by the conveying unit with a screw diameter of 13 mm.

This indicates that when the system speed is increased from V1 to V2, ΔD11 is much smaller than ΔD13, wherein ΔD11 represents the amount of increase in the amount of developer conveyed by the conveying unit with a screw diameter of 11 mm, and ΔD13 represents the amount of increase in the amount of developer conveyed by the conveying unit with a screw diameter of 13 mm.

Accordingly, by setting the conveying power of the second conveying part 232Y to be smaller than that of the first conveying part 231Y as in the present embodiment, the amount of increase in the total pressure at the first branch point P when the system speed is switched from the low-speed mode to the high-speed mode is reduced. This makes it possible to restrict the amount of developer that passes the third conveying part 233Y and flows in the developer ejection passage 241Y to be ejected to outside. This makes it possible for the present developing device to restrict the variation in the amount of developer in the developing unit 33Y which occurs due to the variation in the system speed, more than the conventional technology.

From this point of view, it can be said that the larger the difference between the second conveying part 232Y and the first conveying part 231Y in the developer conveying power is, the more restricted is the variation in the amount of developer. However, if the difference is too large, there is a possibility that the amount of developer remaining at the second branch point Q increases, and the developer plugs the passage at this point. If, to prevent such a case from occurring, the position of the opening of the second communication path 136Y is lowered or the flow passage cross sectional area is increased, there is a possibility that much developer does not reach the first branch point P and circulates in the developing tank via the second communication path 136Y, and the function to adjust the amount of ejected developer by the pressure of the developer at the first branch point P cannot exert the ability well.

It is therefore desirable that the conveying power of the second conveying part 232Y is within a range from 50% to 80% of the conveying power of the first conveying part 231Y so as to ensure the function to keep a smooth developer circulating state and to adjust the amount of ejected developer appropriately, while restricting the amount of developer from varying due to a variation of the system speed.

<Evaluation Experiment>

The inventors of the present application conducted an evaluation experiment to certify the effect of the present embodiment, evaluating the stability of the amount of developer that remains in the developing tank when the printer 1 is switched between the low-speed mode and the high-speed mode.

Figure 6:
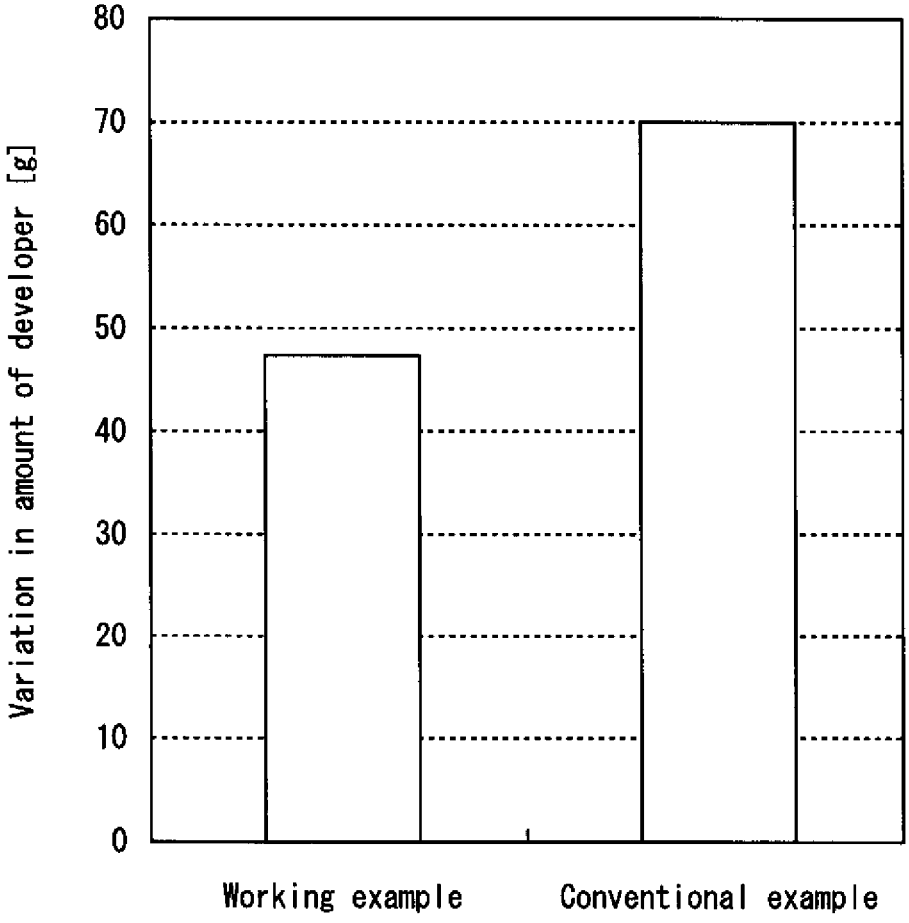
FIG. 6 illustrates the variation in the amount of developer in each of a conventional example and a working example in the embodiment of the present invention.

FIG. 6 illustrates a result of an experiment in which the variation in the amount of developer that remains in the developing tank was measured when the system speed of the printer 1 was switched from the low-speed mode to the high-speed mode.

The conditions for this experiment are as follows.

<Items Common to Working Examples and Conventional Examples>

System speed in high-speed mode: 250 mm/sec

System speed in low-speed mode: 125 mm/sec

Rotation speed of supply screw 132Y in high-speed mode: 600 rpm in low-speed mode: 300 rpm Pitch of first conveying part 231Y: 25 mm Diameter: 13 mm Pitch of third conveying part 233Y: 5 mm Number of turns: 3

Diameter: 11 mm

Pitch of fourth conveying unit 234Y: 12.5 mm

Diameter: 11 mm

H1—height of opening of first communication path 137Y (see FIG. 4B): 7.1 mm W1—width of opening of first communication path 137Y (see FIG. 4B): 7.1 mm Height of lower side of opening of first communication path 137Y in vertical direction (height of portion from lowest point of first conveying part 231Y to lower side of opening of first communication path 137Y in vertical direction): 1 mm <Items Unique to Working Examples>

Working examples differ from conventional examples in the following two points.

(1) In working examples, the supply screw 132Y includes the second conveying part 232Y. On the other hand, the conventional examples do not include the second conveying part 232Y, and a portion corresponding to the second conveying part 232Y has the same shape as the first conveying part 231Y.

(2) In working examples, the second communication path 136Y is provided. On the other hand, the conventional examples do not have the second communication path 136Y.

The following shows measurements of the structures unique to the working examples.

Pitch of second conveying part 232Y: 12.5 mm

Diameter: 11 mm (In the working examples, both the screw pitch and diameter of the second conveying part 232Y are set to be smaller than those of the first conveying part 231Y, so that the conveying power of the second conveying part 232Y is approximately 60% of the conveying power of the first conveying part 231Y)

H2—height of opening of second communication path 136Y (see FIG. 3B): 5 mm W2—width of opening of second communication path 136Y (see FIG. 3B): 5 mm Height of lower side of opening of second communication path 136Y in the vertical direction (height of portion from lowest point of first conveying part 231Y to lower side of opening of first communication path 136Y in vertical direction): 9 mm Note that, in the present experiment, each measurement is set so that an appropriate amount of developer as designed is contained in a stable manner in the developing tank in the high-speed mode in which basically regular paper is used.

<Other Items>

If the printer 1 has been installed on a slanted floor, the ejection of developer from the developing unit 33Y may be promoted or restricted depending on the slanting angle of the printer 1.

In view of this, in the above evaluation experiment, in the high-speed mode in which the ejection of developer is promoted, the printer 1 including the developing unit 33Y was installed at an angle slanted toward a direction in which the ejection of developer is promoted. More specifically, the developing unit 33Y was slanted by 3° from a horizontal plane such that, in the example shown in FIG. 2, a portion of the developing unit 33Y on the y direction side is lower than a portion on the y' direction side.

Also, in the low-speed mode in which the ejection of developer is restricted, the printer 1 including the developing unit 33Y was installed at an angle slanted toward a direction in which the ejection of developer is restricted. More specifically, the developing unit 33Y was slanted by 3° from a horizontal plane such that, in the example shown in FIG. 2, a portion of the developing unit 33Y on the y direction side is higher than a portion on the y' direction side.

Note that a slant of a printer installed on a location where the printer is delivered is generally presumed to be in the range of ±1.5°, and thus the above slant of 3° is a severer condition than this generally presumed range.

The vertical axis of the graph shown in FIG. 6 indicates the variation in the amount of developer in the developing unit 33Y when the system speed is switched, the amount being obtained by subtracting the amount of developer in the developing unit 33Y at the system speed in the high-speed mode from the amount of developer in the developing unit 33Y at the system speed in the low-speed mode.

As shown in FIG. 6, the variation in the amount of developer is approximately 47 g in the case of the working example, and approximately 70 g in the case of the conventional example. This clearly indicates that, even if the system speed changes, the variation in the amount of developer in the developing unit is more restricted in the working example than in the conventional example.

As described above, in the developing unit 33Y of the present embodiment, even if the system speed increases, since the conveying power of the second conveying part 232Y is set to be smaller than that of the first conveying part 231Y, it is possible to restrict a range of increase in the conveying power of the second conveying part 232Y, reducing the variation in the pressure of the developer at the first branch point P.

This reduces the variation in the amount of developer that enters the developer ejection passage 241Y passing the third conveying part 233Y to be ejected, stabilizing the amount of developer in the developing unit, and preventing a defect such as an uneven image from occurring to some extent.

Note that the other developing units 33C through 33K produce similar effects since they have the same structure as the developing unit 33Y.

<Modifications>

The present invention is not limited to the above embodiment, but can be modified as follows, for example.

(1) In the above embodiment, the spiral direction of the screws of the third conveying part 233Y is reversed to that of the screws of the second conveying part 232Y so that the developer enters the developer ejection passage 241Y depending on the pressure of developer at the first branch point P, and is ejected from the developer outlet hole 139Y. However, not limited to this structure, other structures may be adopted.

For example, the third conveying part 233Y may be provided with, instead of the spiral vanes, one or more disks perpendicular to the shaft, with a slight space between the disks and the inner wall of the third conveying part 233Y. Alternatively, in the developer ejection passage 241Y, one or more brushes may be provided to stand on the wall surface of the housing 134Y surrounding the third conveying part 233Y. In essence, any means may be provided as far as the means has a structure for allowing developer to enter the developer ejection passage 241Y depending on the pressure of the developer on the first conveying passage side.

(2) In the above embodiment, the stirring screw 133Y in the second conveying passage 244Y is not partially changed in shape of screw. However, for example, as shown in FIG. 7, a portion of the stirring screw 133Y between the first communication path 137Y and the second communication path 136Y may be attached with plate-like paddles 334Y for enhancing the stirring power, the portion of the stirring screw 133Y attached with the paddles 334Y being referred to as a stirring power enhancing portion 333Y.

With this structure, in a region of the second conveying passage 244Y in the vicinity of the first communication path 137Y where the developer in the developing tank having flowed via the first communication path 137Y and the developer newly replenished via the developer inlet hole 138Y are mixed for the first time, the stirring of the new and old developers is promoted from an earlier stage, making it possible to mix these developers sufficiently, and increasing the uniformity of the developers.

Furthermore, in the stirring power enhancing portion 333Y, in addition to or in place of the paddles 334Y, the screw pitch in this portion may be decreased. With this structure, in the stirring power enhancing portion 333Y, the developer is conveyed at a slower speed and the time period during which the developer is stirred becomes longer than the general conveying portion, namely, the portion other than the stirring power enhancing portion 333Y of the stirring screw 133Y. Accordingly, this structure enhances the stirring power of the stirring power enhancing portion 333Y.

Figure 7:
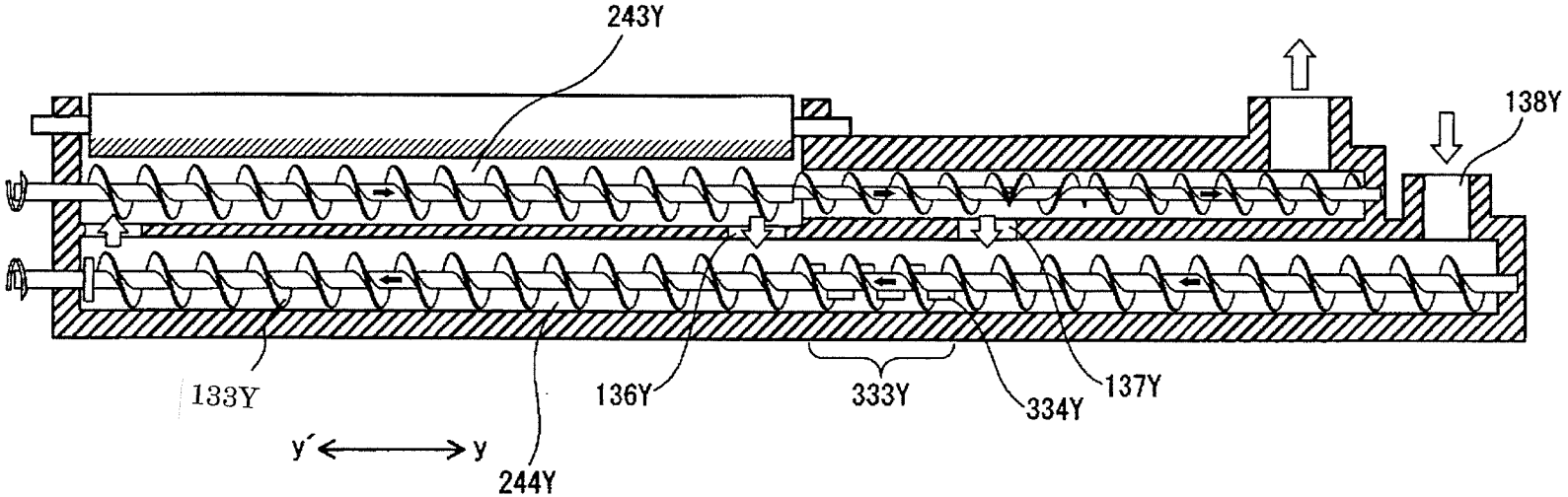
FIG. 7 illustrates the structure of the developing device in a modification of the present invention.
Figure 8:
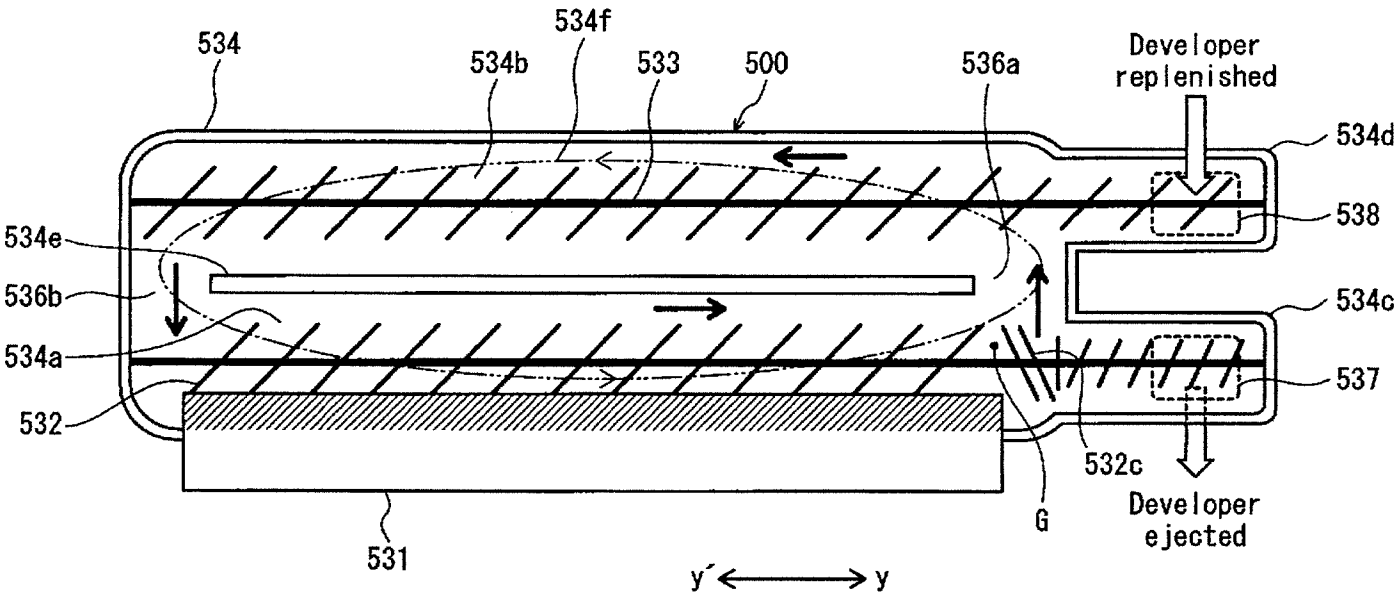
FIG. 8 PRIOR ART
FIG. 8 is a schematic cross sectional view illustrating the structure of a developing device in a conventional image foaming apparatus.

Note that although it is only necessary to form the stirring power enhancing portion 333Y at least at a portion that is downstream of the first communication path 137Y of the stirring screw 133Y, in order to stir the old developer and the newly replenished developer as early as possible to make them uniform, while preventing developer from flowing in from the first conveying passage 243Y via the second communication path 136Y to prevent a developer clogging from occurring, it is desirable to form the stirring power enhancing portion 333Y in a region between the first communication path 137Y and the second communication path 136Y, as shown in FIG. 7.

(3) In the example of the above evaluation experiment, in order to make the second conveying part 232Y smaller than the first conveying part 231Y in conveying power, the second conveying part 232Y is set to be smaller than the first conveying part 231Y in both screw diameter and screw pitch. However, not limited to this, the second conveying part 232Y may be set to be smaller than the first conveying part 231Y in either screw diameter or screw pitch.

Furthermore, like the paddles 334Y shown in FIG. 7, if paddles are provided between vanes of the spiral screw of the second conveying part 232Y, the conveying power per unit time will be decreased. Accordingly, such paddles may be attached in addition to or in place of the change in screw diameter or pitch.

Note that if the second conveying part 232Y is smaller, even if only slightly, than the first conveying part 231Y in conveying power, the amount of developer is more stable relative to the change in system speed, than at least conventional technologies. Also, it is considered that, when the difference between the second conveying part 232Y and the first conveying part 231Y in conveying power is smaller than a predetermined level, the amount of developer remaining at the second branch point Q is small. In that case, there may not be necessary to provide the second communication path 136Y.

(4) In the above embodiment, in the case of regular paper, images are formed with driving at a high-speed (high-speed mode), and in the case of thick paper or an OHP sheet, images are formed with driving at a low-speed (low-speed mode). However, the variation of the system speed is not limited to this.

For example, when an image is printed in monochrome on regular paper, not in color, there is no particular distinction in image quality even if the system speed is higher than the speed of the high-speed mode. Accordingly, for monochrome printing, a third mode in which the system speed is further higher than the speed of the high-speed mode may be adopted.

Even if such a higher-speed third mode is adopted, the developing device in the present embodiment is effective in stabilizing the amount of developer in the developing unit.

(5) In the above embodiment, specific measurements of the screws are indicated with regard to the first conveying part 231Y, second conveying part 232Y, third conveying part 233Y and fourth conveying unit 234Y. However, these measurements are merely examples, and the measurements of screws of these units should be determined appropriately depending on the system speed, the capacity of the housing 134Y and the like.

Also, in the above embodiment, the first conveying part 231Y in the first conveying passage 243Y (see FIG. 2) is provided in approximately correspondence with the length of the developing roller 131Y. However, the first conveying part 231Y may be longer than the developing roller 131Y as far as it includes a portion that corresponds to the length of the developing roller 131Y.

(6) In the above embodiment, a tandem color printer is described. However, the present invention is not limited to this, but may be applied to all image forming apparatuses provided with a developing device of a trickle developing system.

Also, the present invention may be any combination of the above embodiment and modifications.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. A developing device supplying a two-component developer to a developing roller, while causing the developer to circulate in a circulating passage including a first conveying passage and a second conveying passage arranged in parallel to each other, and while ejecting a part of the developer to outside via an ejection passage formed as an extension of the first conveying passage on a downstream side in a developer conveying direction, the developing roller being provided along the first conveying passage, the developing device comprising:

a first communication path provided as a branch of the first conveying passage on the downstream side in the developer conveying direction and configured to allow the first conveying passage to communicate with the second conveying passage;

a first conveying part configured to convey the developer in the first conveying passage toward the first communication path;

an entrance allowance unit configured to allow the developer to enter the ejection passage from the first conveying passage depending on a pressure of the developer in the first conveying passage, the first conveying part including a main conveying part and a sub-conveying part, the main conveying part being provided in a region corresponding to the developing roller, and the sub-conveying part, provided downstream of the main conveying part in the developer conveying direction, conveying a smaller amount of developer per unit time than the main conveying part; and a second communication path provided at a position corresponding to an end of the main conveying part and upstream of the sub-conveying part in the developer conveying direction, and allows the first conveying passage to communicate with the second conveying passage;

wherein:

the second communication path, the first communication path, and the ejection passage are arranged in order along the developer conveying direction in the first conveying passage;

the first conveying passage and the second conveying passage are arranged in parallel to each other with a partition wall therebetween, the first communication path and the second communication path are a first opening and a second opening provided in the partition wall, respectively, and a lowest portion of the second opening is higher than a lowest portion of the first opening in position in a vertical direction.

2. The developing device of claim 1, wherein the second communication path is smaller than the first communication path in flow passage cross sectional area.

3. The developing device of claim 1, wherein the first conveying part is a screw driven by a driving source to rotate, and the sub-conveying part is smaller than the main conveying part in screw diameter.

4. The developing device of claim 1, wherein the entrance allowance unit conveys a smaller amount of developer per unit time than the sub-conveying part, and conveys the developer in a reverse direction of a direction in which the sub-conveying part conveys the developer.

5. The developing device of claim 1, wherein a replenishing path, through which developer is replenished, is provided in the second conveyance passage on an upstream side in the developer conveying direction.

6. A developing device supplying a two-component developer to a developing roller, while causing the developer to circulate in a circulating passage including a first conveying passage and a second conveying passage arranged in parallel to each other, and while ejecting a part of the developer to outside via an ejection passage formed as an extension of the first conveying passage on a downstream side in a developer conveying direction, the developing roller being provided along the first conveying passage, the developing device comprising:

a first communication path provided as a branch of the first conveying passage on the downstream side in the developer conveying direction and configured to allow the first conveying passage to communicate with the second conveying passage;

a first conveying part configured to convey the developer in the first conveying passage toward the first communication path; and an entrance allowance unit configured to allow the developer to enter the ejection passage from the first conveying passage depending on a pressure of the developer in the first conveying passage;

the first conveying part including a main conveying part and a sub-conveying part, the main conveying part being provided in a region corresponding to the developing roller, and the sub-conveying part, provided downstream of the main conveying part in the developer conveying direction, conveying a smaller amount of developer per unit time than the main conveying part;

wherein:

another communication path, through which the developer is received from the second conveying passage, is provided in the first conveyance passage on a most upstream side in the developer conveying direction, and a second conveying part conveying the developer in the second conveying passage toward the another communication path is provided in the second conveying passage, and the second conveying part includes a general conveying portion and a stirring power enhancing portion, the stirring power enhancing portion being greater than the general conveying portion in capability to stir the developer, and the stirring power enhancing portion is provided downstream of at least the first communication path in the developer conveying direction.

7. The developing device of claim 6, wherein the second conveying part is a screw driven by a driving source to rotate, and the stirring power enhancing portion is a portion of the screw attached with plate-like paddles between vanes of the screw.

8. An image forming apparatus provided with a developing device supplying a two-component developer to a developing roller, while causing the developer to circulate in a circulating passage including a first conveying passage and a second conveying passage arranged in parallel to each other, and while ejecting a part of the developer to outside via an ejection passage formed as an extension of the first conveying passage on a downstream side in a developer conveying direction, the developing roller being provided along the first conveying passage, the developing device including:

a first communication path provided as a branch of the first conveying passage on the downstream side in the developer conveying direction and configured to allow the first conveying passage to communicate with the second conveying passage;

a first conveying part configured to convey the developer in the first conveying passage toward the first communication path;

an entrance allowance unit configured to allow the developer to enter the ejection passage from the first conveying passage depending on a pressure of the developer in the first conveying passage;

the first conveying part including a main conveying part and a sub-conveying part, the main conveying part being provided in a region corresponding to the developing roller, and the sub-conveying part, provided downstream of the main conveying part in the developer conveying direction, conveying a smaller amount of developer per unit time than the main conveying part, and a second communication path provided at a position corresponding to an end of the main conveying part and upstream of the sub-conveying part in the developer conveying direction, and allows the first conveying passage to communicate with the second conveying passage;

wherein:

the second communication path, the first communication path, and the ejection passage are arranged in order along the developer conveying direction in the first conveying passage;

the first conveying passage and the second conveying passage are arranged in parallel to each other with a partition wall therebetween, the first communication path and the second communication path are a first opening and a second opening provided in the partition wall, respectively, and a lowest portion of the second opening is higher than a lowest portion of the first opening in position in a vertical direction.

9. An image forming apparatus provided with a developing device supplying a two-component developer to a developing roller, while causing the developer to circulate in a circulating passage including a first conveying passage and a second conveying passage arranged in parallel to each other, and while ejecting a part of the developer to outside via an ejection passage formed as an extension of the first conveying passage on a downstream side in a developer conveying direction, the developing roller being provided along the first conveying passage, the developing device including:

a first communication path provided as a branch of the first conveying passage on the downstream side in the developer conveying direction and configured to allow the first conveying passage to communicate with the second conveying passage;

a first conveying part configured to convey the developer in the first conveying passage toward the first communication path;

an entrance allowance unit configured to allow the developer to enter the ejection passage from the first conveying passage depending on a pressure of the developer in the first conveying passage;

the first conveying part including a main conveying part and a sub-conveying part, the main conveying part being provided in a region corresponding to the developing roller, and the sub-conveying part, provided downstream of the main conveying part in the developer conveying direction, conveying a smaller amount of developer per unit time than the main conveying part;

wherein:

another communication path, through which the developer is received from the second conveying passage, is provided in the first conveyance passage on a most upstream side in the developer conveying direction, and a second conveying part conveying the developer in the second conveying passage toward the another communication path is provided in the second conveying passage, and the second conveying part includes a general conveying portion and a stirring power enhancing portion, the stirring power enhancing portion being greater than the general conveying portion in capability to stir the developer, and the stirring power enhancing portion is provided downstream of at least the first communication path in the developer conveying direction.

10. The image forming apparatus of claim 9, wherein the second conveying part is a screw driven by a driving source to rotate, and the stirring power enhancing portion is a portion of the screw attached with plate-like paddles between vanes of the screw.

* * * * *